US009889463B2

(12) United States Patent
Ikushima

(10) Patent No.: US 9,889,463 B2
(45) Date of Patent: Feb. 13, 2018

(54) LIQUID MATERIAL DISCHARGE DEVICE AND DISCHARGE METHOD

(71) Applicant: MUSASHI ENGINEERING, INC., Mitaka-shi, Tokyo (JP)

(72) Inventor: Kazumasa Ikushima, Mitaka (JP)

(73) Assignee: MUSASHI ENGINEERING, INC., Tokyo (JP)

( * ) Notice: Subject to any disclaimer, the term of this patent is extended or adjusted under 35 U.S.C. 154(b) by 163 days.

(21) Appl. No.: 14/376,802

(22) PCT Filed: Feb. 4, 2013

(86) PCT No.: PCT/JP2013/052448
§ 371 (c)(1),
(2) Date: Aug. 5, 2014

(87) PCT Pub. No.: WO2013/118669
PCT Pub. Date: Aug. 15, 2013

(65) Prior Publication Data

US 2015/0014362 A1 Jan. 15, 2015

(30) Foreign Application Priority Data

Feb. 6, 2012 (JP) ..... 2012-023465

(51) Int. Cl.
*B05C 11/10* (2006.01)
*B05C 5/02* (2006.01)
*B05B 1/30* (2006.01)

(52) U.S. Cl.
CPC ..... *B05C 11/1034* (2013.01); *B05C 5/0225* (2013.01); *B05B 1/3046* (2013.01);
(Continued)

(58) Field of Classification Search
CPC . B05C 5/0225; B05C 11/1034; B05C 5/0291; B05C 5/00; B05C 11/1013;
(Continued)

(56) References Cited

U.S. PATENT DOCUMENTS 4,104,983 A * 8/1978 Carstedt ..... B65H 45/30 118/32
4,535,821 A * 8/1985 Anderson ..... B01F 5/0413 137/625.37

(Continued)

FOREIGN PATENT DOCUMENTS

CN 101674892 A 3/2010
JP 62-200079 A 9/1987

(Continued)

OTHER PUBLICATIONS

International Search Report of PCT/JP2013/052448, dated May 7, 2013.

(Continued)

*Primary Examiner* — Paul R Durand
*Assistant Examiner* — Andrew P Bainbridge
(74) *Attorney, Agent, or Firm* — Westerman, Hattori, Daniels & Adrian, LLP

(57) ABSTRACT

The present invention provides a discharge device (1) including a liquid chamber (13) that is communicated with a discharge port (11) and is supplied with a liquid material, a plunger (33) that is coupled to a piston (30), and that advances and retreats within the liquid chamber (13) in a state not in contact with a lateral surface of the liquid chamber (13), a resilient member (40) that applies a biasing force to the plunger (33), a main body (2) including a piston chamber (20) in which the piston (30) is disposed, solenoid valves (61, 62, 63 and 64) that supply a pressurized gas, supplied from a pressurized gas source, to the piston cham-
(Continued)

ber (20), or that exhaust the pressurized gas from the piston chamber (20), and a controller (90) that controls operations of the solenoid valves (61, 62, 63 and 64), wherein the solenoid valves (61, 62, 63 and 64) are connected to the piston chamber (20) in parallel. With those features, the size of the discharge device can be reduced, and the plunger can be operated at a high speed.

25 Claims, 9 Drawing Sheets

(52) U.S. Cl.
CPC ..... *B05C 5/0237* (2013.01); *B05C 5/0279* (2013.01); *B05C 5/0291* (2013.01)

(58) Field of Classification Search
CPC ... B05C 11/10; B05C 5/0237; B05C 11/1026; B05B 1/304; B05B 1/306; B05B 1/3046; B05B 1/3053; B05D 1/26; B05D 1/02; F15B 15/04; F15B 15/14; F15B 15/088; F15B 15/1404; F15B 15/149; F16K 1/54; F16K 31/06; A62C 37/20; F17D 3/00
USPC ..... 222/334, 340, 420–422, 505–506, 222/531–532, 566, 504; 239/562, 584, 239/373; 427/421.1; 118/696, 300; 137/1, 624.13, 625.28, 65.4
See application file for complete search history.

(56) References Cited

U.S. PATENT DOCUMENTS 4,759,477 A * 7/1988 Gelinas ..... B05C 11/00 222/504
5,016,786 A * 5/1991 Horino ..... B67D 1/06 222/190
5,088,443 A * 2/1992 Hastings ..... B05B 5/03 118/300
5,277,333 A * 1/1994 Shimano ..... G05D 7/0658 222/14
5,927,560 A * 7/1999 Lewis ..... B05C 11/1034 222/263
5,934,521 A * 8/1999 Yamada ..... B05B 1/3046 222/146.2
6,037,009 A * 3/2000 Clare ..... B05B 12/04 427/207.1
6,206,045 B1 * 3/2001 Hayashi ..... F15B 13/0817 137/269
6,253,957 B1 * 7/2001 Messerly ..... B05C 5/001 222/1
6,669,057 B2 * 12/2003 Saidman ..... B05C 5/001 137/375
7,028,867 B2 * 4/2006 Acum ..... B05B 7/066 222/504
7,134,617 B2 11/2006 Ikushima
8,104,649 B2 * 1/2012 Riney ..... B05C 5/001 222/146.5
8,439,226 B2 * 5/2013 Fort ..... B05C 5/001 118/685
8,448,818 B2 5/2013 Ikushima
8,608,025 B2 * 12/2013 MacIndoe ..... B05B 9/04 222/1
8,807,400 B2 8/2014 Ikushima
2007/0205384 A1 * 9/2007 Kurosawa ..... F15B 13/081 251/127
2013/0048759 A1 2/2013 Aguilar et al.
2013/0052359 A1 2/2013 Ahmadi et al.
2016/0199857 A1 7/2016 Aguilar et al.
2016/0221022 A1 8/2016 Aguilar et al.

FOREIGN PATENT DOCUMENTS

JP 4-22668 U 2/1992
JP 2000-227174 A 8/2000
JP 2004-215554 A 8/2004
JP 2004-308796 A 11/2004
JP 4663894 B2 4/2011
TW 201318712 A 5/2013
WO 2008/108097 A1 9/2008

OTHER PUBLICATIONS

Office Action dated Dec. 28, 2015, issued in counterpart Chinese Patent Application No. 201380008263.0, with English translation. (4 pages).
Office Action dated Oct. 3, 2016, issued in counterpart Taiwanese Patent Application No. 102104546. (9 pages).

* cited by examiner

[Fig.1]
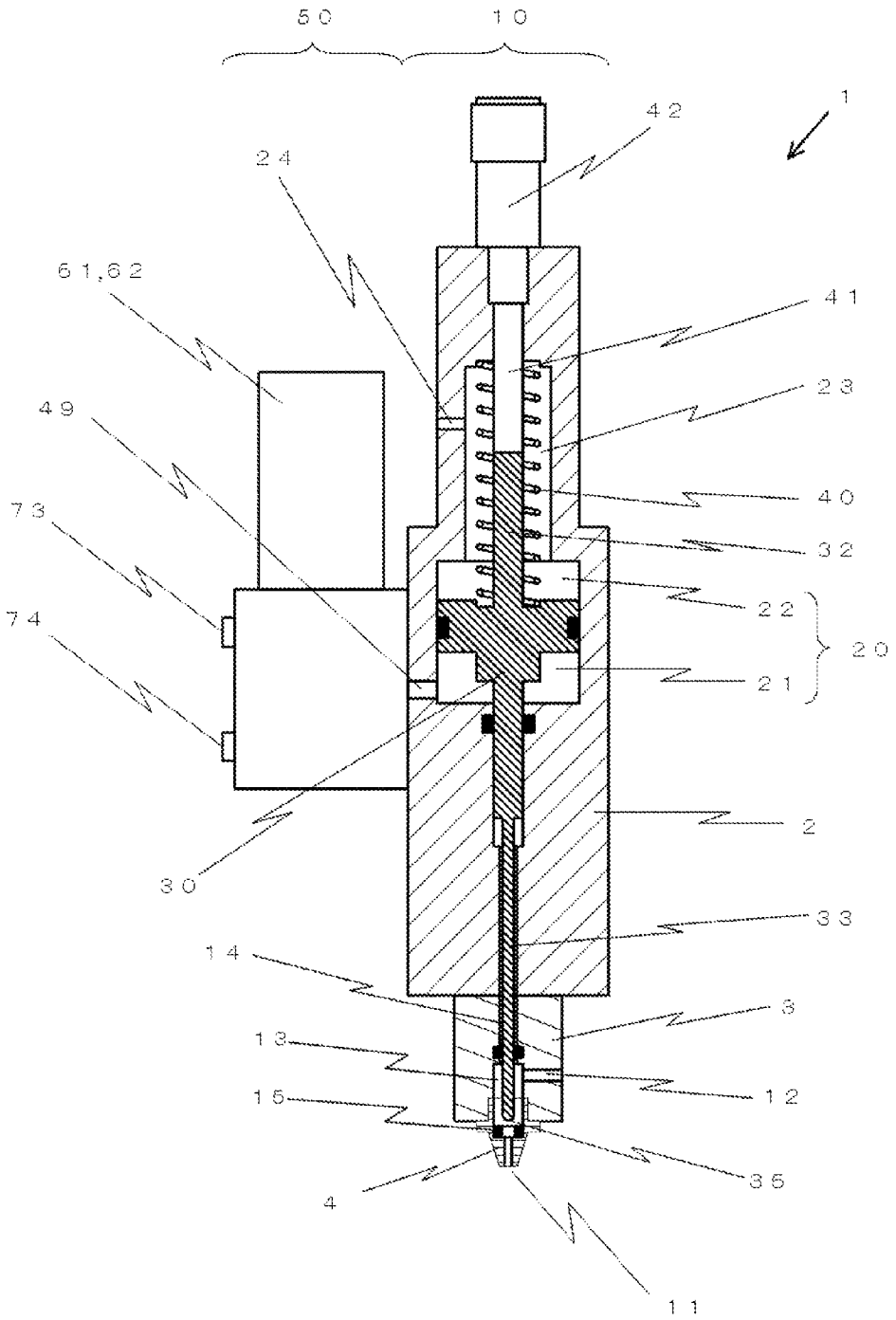

[Fig.2]
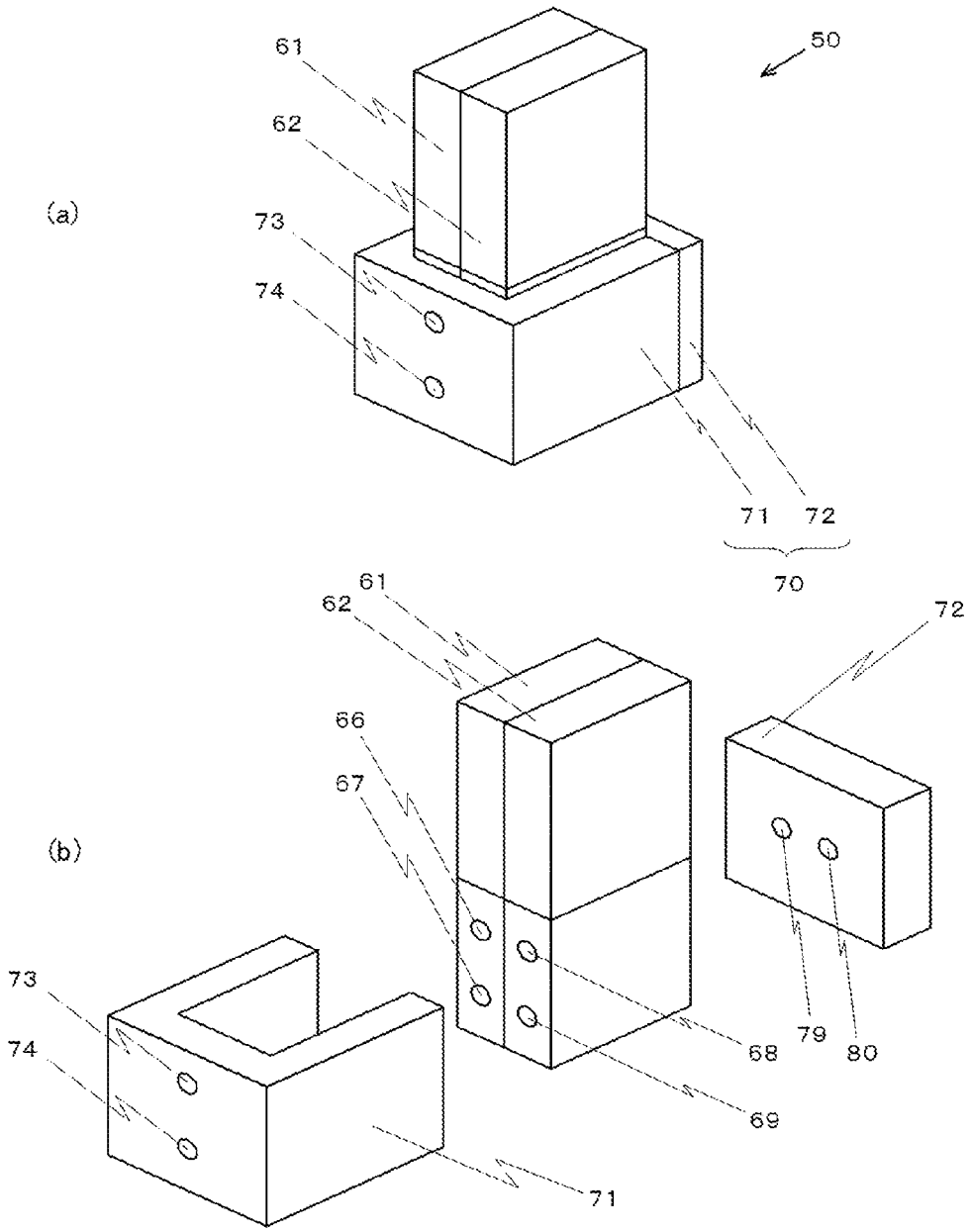

[Fig.3]
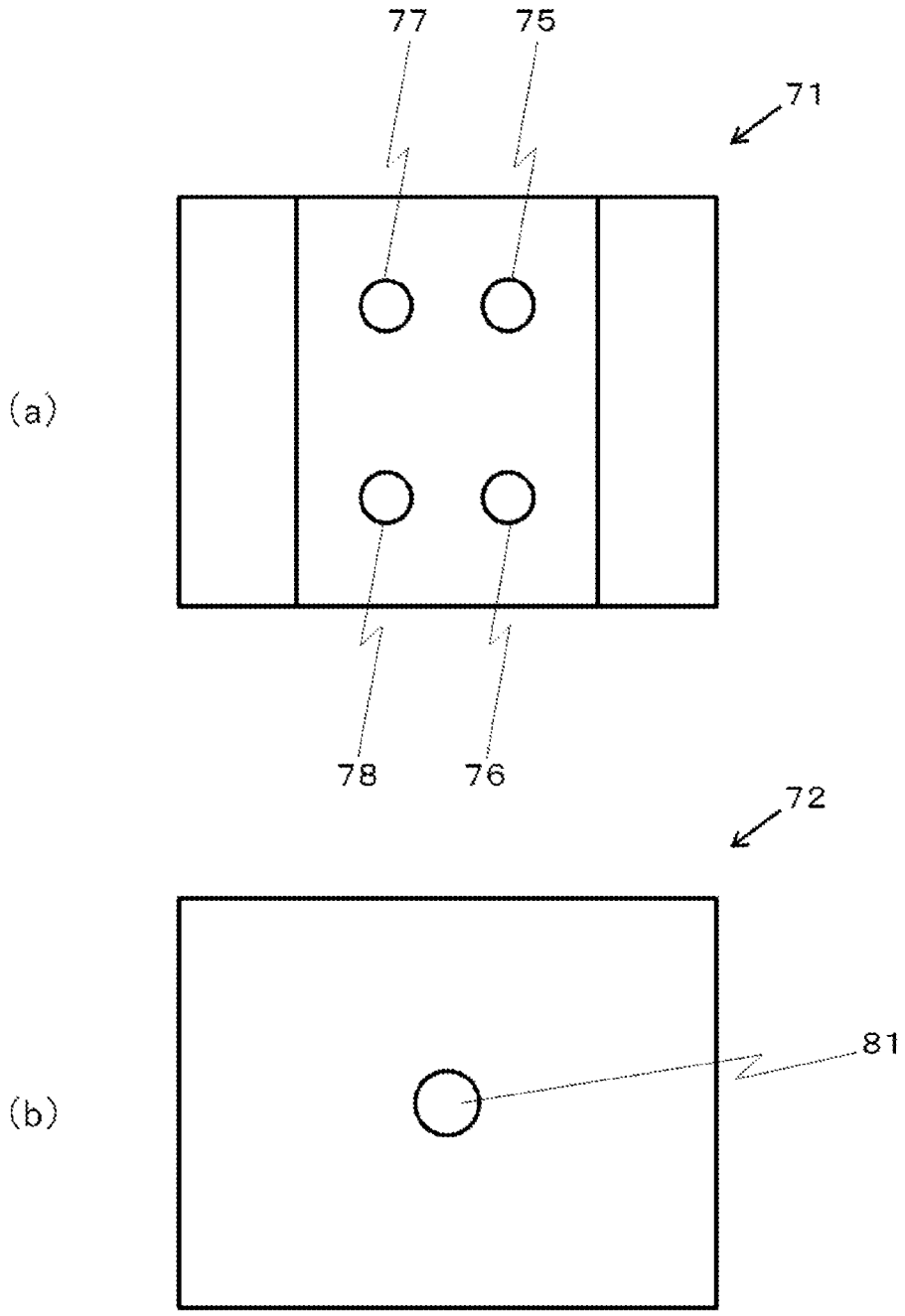

[Fig.4]
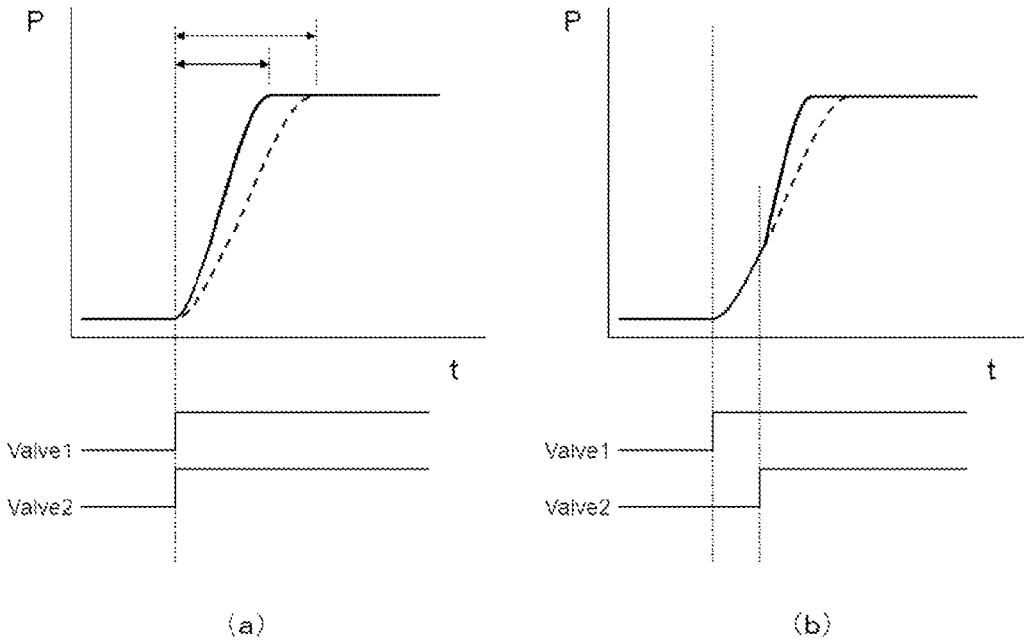

[Fig.5]
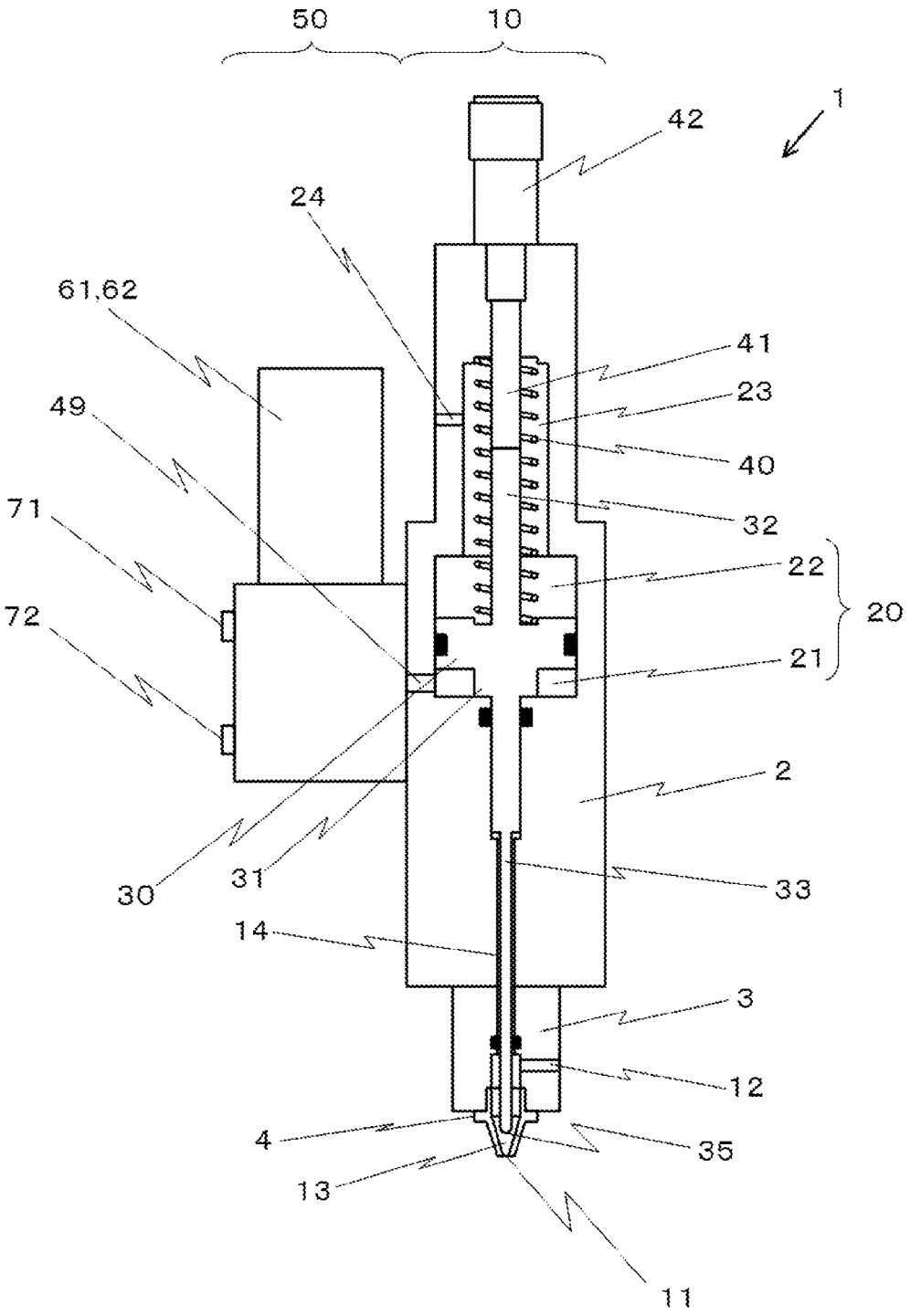

[Fig.6]
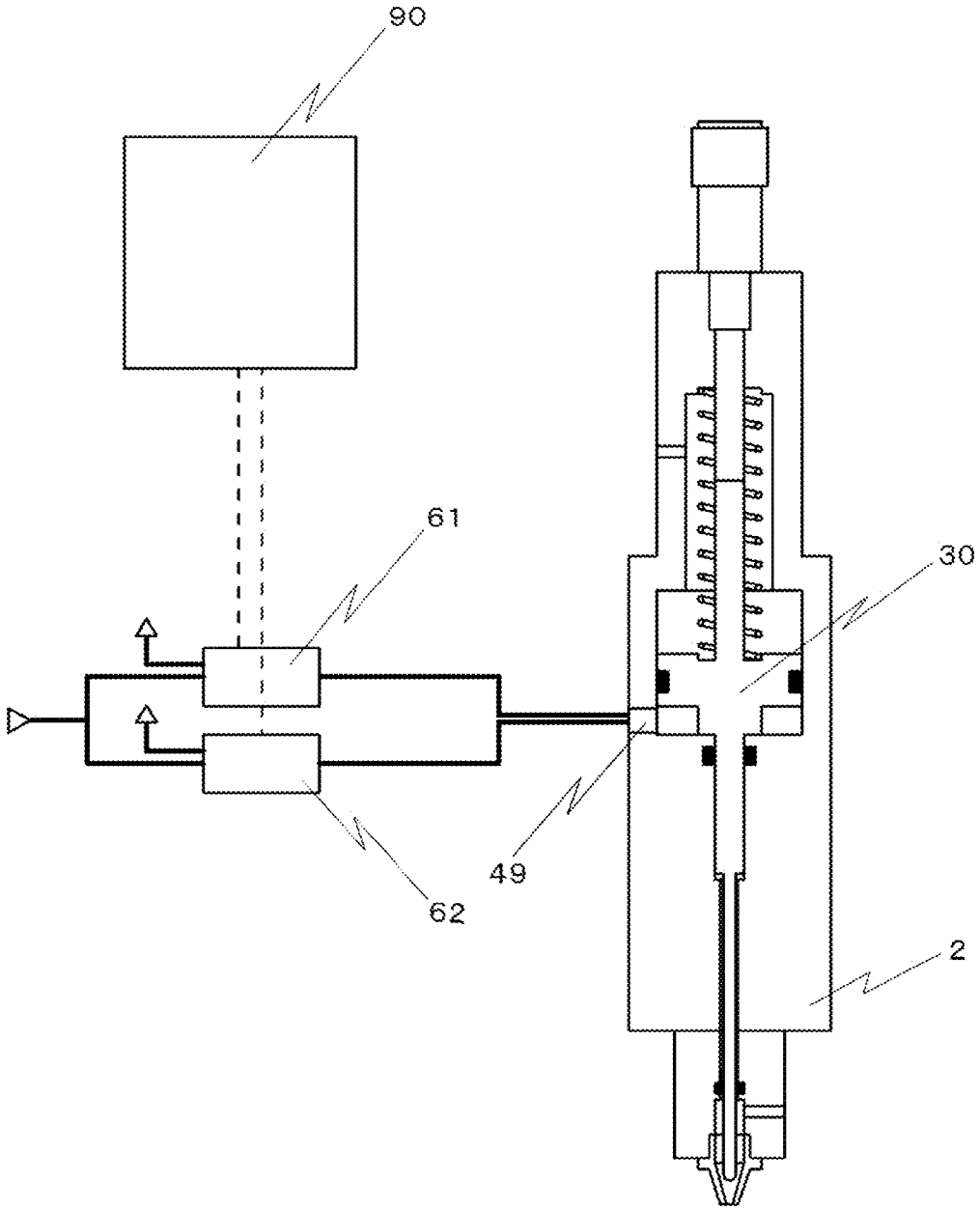

[Fig.7]
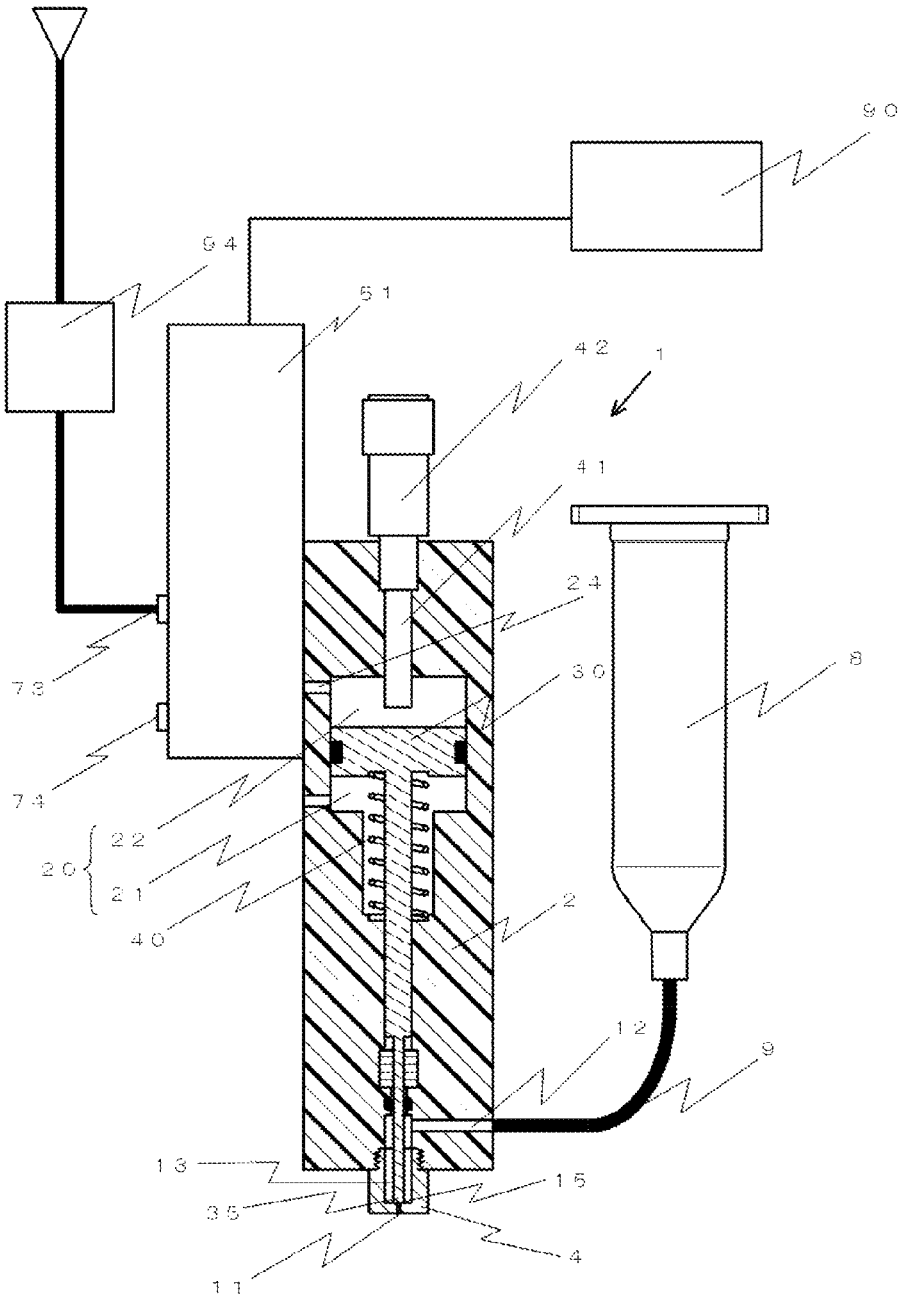

[Fig.8]
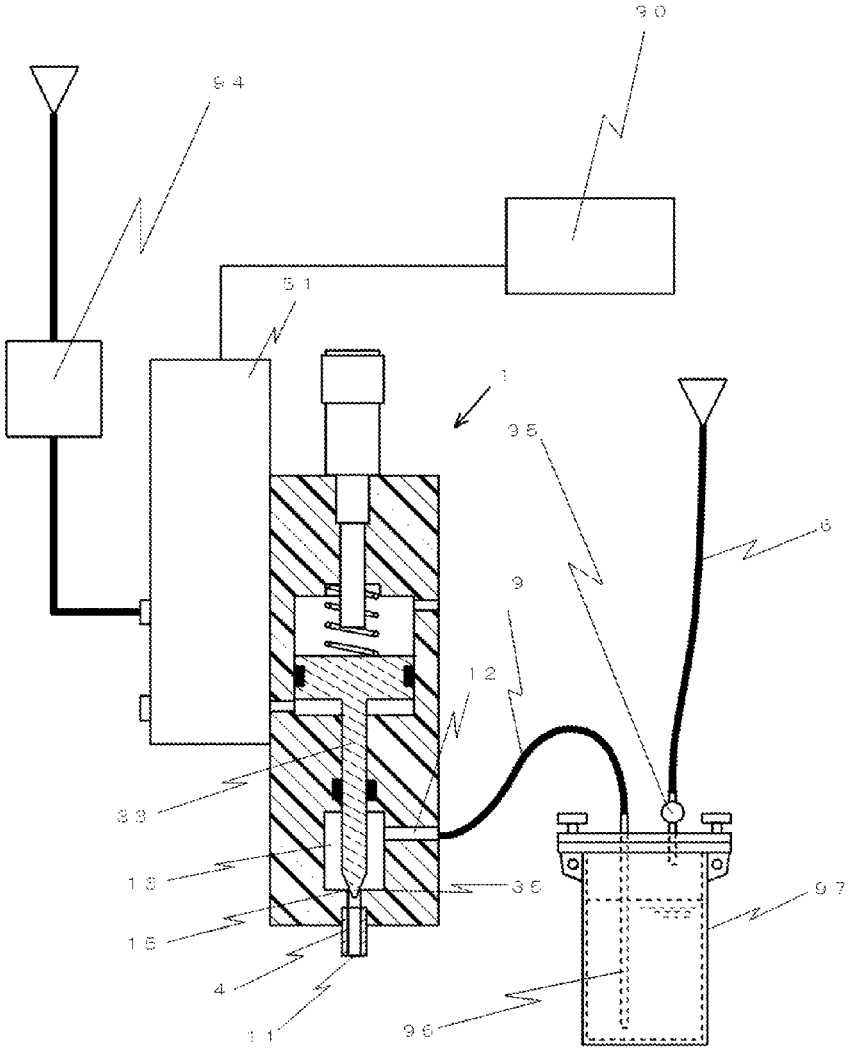

[Fig.9]
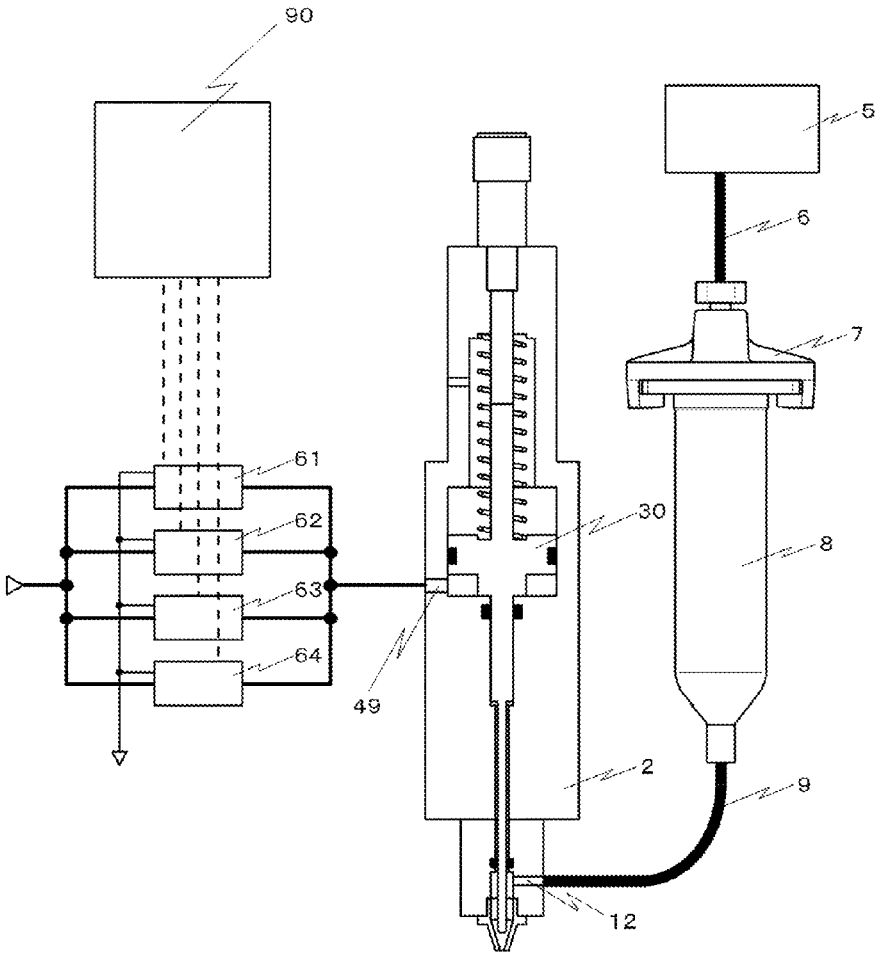

LIQUID MATERIAL DISCHARGE DEVICE AND DISCHARGE METHOD

TECHNICAL FIELD

The present invention relates to a liquid material discharge device and discharge method, which can supply compressed air in amount sufficient to continuously perform a discharge operation at a high speed.

BACKGROUND ART

As a device for continuously discharging a liquid material in the form of droplets at a high speed, there is known the type of quickly advancing a plunger in a liquid chamber, which has a discharge port, toward the discharge port and then abruptly stopping the plunger such that the liquid material is discharged in the form of a droplet from the discharge port.

A device disclosed in Patent Document 1, proposed by the applicant, is one example of a droplet dispensing device in which a tip of a plunger is abruptly stopped by abutting the tip against a valve seat, thus causing a liquid to be discharged in the form of a droplet flying from a discharge port of a valve.

A device disclosed in Patent Document 2, proposed by the applicant, is one example of a droplet discharge device in which a plunger is advanced and then stopped in a state where a tip of the plunger and an inner wall of a liquid chamber are not contacted with each other, thus applying an inertial force to a liquid material and discharging the liquid material in the form of a droplet.

LIST OF PRIOR-ART DOCUMENTS

Patent Documents

Patent Document 1: Japanese Patent No. 4663894

Patent Document 2: International Publication Pamphlet No. WO2008/108097

SUMMARY OF THE INVENTION

Problems to be Solved by the Invention

The above-mentioned devices of prior art can continuously discharge the liquid material in the form of a droplet at a high speed. In practical fields, however, a discharge device capable of continuously discharging the liquid material at a higher tact is demanded from the viewpoint of increasing productivity.

One effective solution for realizing the higher tact is to increase the pressure of air for operating the plunger. However, this solution requires flow passages, etc. in the discharge device to be endurable against the higher pressure, thus leading to the problem that the size and the weight of the device are increased. Assuming the case of carrying out work on a desk, an increase in the size and the weight of the device has to be avoided.

In consideration of the above-described state of the art, an object of the present invention is to provide a liquid material discharge device and discharge method, which can perform continuous discharge at a higher tact than in the past while the device size is held small.

Means for Solving the Problems

With attention focused on a solenoid valve having a relatively small in the entire device, the inventor has accomplished the present invention based on the finding that a higher tact in the continuous discharge can be realized by arranging a plurality of solenoid valves in parallel. Thus, the present invention is constituted by the following technical means.

According to a first invention, there is provided a liquid material discharge device comprising a liquid chamber that is communicated with a discharge port and is supplied with a liquid material, a plunger that is coupled to a piston, and that has a tip advancing and retreating within the liquid chamber in a state not in contact with a lateral surface of the liquid chamber, a resilient member that applies a biasing force to the plunger, a main body including a piston chamber in which the piston is disposed, a solenoid valve that supplies a pressurized gas, supplied from a pressurized gas source, to the piston chamber, or that exhausts the pressurized gas from the piston chamber, and a controller that controls operation of the solenoid valve, wherein the solenoid valve is constituted by a plurality of solenoid valves that are connected to the piston chamber in parallel.

According to a second invention, in the first invention, the liquid material discharge device further comprises a holder including a holding member that holds the plural solenoid valves, and a relay member that has an inner flow passage communicating the plural solenoid valves with the piston chamber, wherein the holding member has a supply port communicating with the pressurized gas source and has a plurality of delivery ports that distribute the pressurized gas, supplied to the supply port, to the plural solenoid valves, and the relay member has an inner flow passage that communicates the plural solenoid valves with the piston chamber.

According to a third invention, in the second invention, the relay member has a plurality of inner flow passages that communicate the plural solenoid valves individually with the piston chamber.

According to a fourth invention, in the second or third invention, the holder is detachably fixed to the main body.

According to a fifth invention, in any one of the first to fourth inventions, the solenoid valve is constituted by three or four solenoid valves.

According to a sixth invention, in any one of the first to fifth inventions, the controller establishes communication between the pressurized gas source and the piston chamber by the solenoid valves at timing different for each of the solenoid valves.

According to a seventh invention, in any one of the first to sixth inventions, the liquid material discharge device is of desk-top type.

According to an eighth invention, there is provided a liquid material discharge method comprising a step of preparing a liquid material discharge device including a liquid chamber that is communicated with a discharge port and is supplied with a liquid material, a plunger that is coupled to a piston, and that has a tip advancing and retreating within the liquid chamber in a state not in contact with a lateral surface of the liquid chamber, a resilient member that applies a biasing force to the plunger, a main body including a piston chamber in which the piston is disposed, a solenoid valve that supplies a pressurized gas, supplied from a pressurized gas source, to the piston chamber, or that exhausts the pressurized gas from the piston chamber, and a controller that controls operation of the solenoid valve; a step of constituting the solenoid valve by a plurality of solenoid valves that are connected to the piston chamber in parallel; a first step of operating the plural solenoid valves to communicate the pressurized gas source with the piston chamber at desired timings; a second step of operating the plural solenoid valves to communicate the piston chamber with the atmosphere at the same timing; and a third step of continuously discharging droplets by repeating the first and second steps.

According to a ninth invention, in the eighth invention, in the first step, the plural solenoid valves communicate the pressurized gas source with the piston chamber at the same timing.

According to a tenth invention, in the eighth invention, in the first step, the plural solenoid valves successively communicate the pressurized gas source with the piston chamber.

According to an eleventh invention, in the eighth, ninth or tenth invention, the pressurized gas distributively supplied to the plural solenoid valves from one pressurized gas source is supplied to the piston chamber through one flow passage communicating with each of the plural solenoid valves.

According to a twelfth invention, in the eighth, ninth or tenth invention, the pressurized gas distributively supplied to the plural solenoid valves from one pressurized gas source is supplied to the piston chamber through a plurality of flow passages communicating with the plural solenoid valves in one-to-one relation.

According to a thirteenth invention, in any one of the eighth to twelfth inventions, the solenoid valve is constituted by three or four solenoid valves.

According to a fourteenth invention, in any one of the eighth to thirteenth inventions, in the second step, the plunger is advanced and stopped in a state that the plunger tip is not contacted with an inner wall of the liquid chamber, the inner wall being present in an advancing direction of the plunger, thereby applying an inertial force to the liquid material and discharging the liquid material in form of a droplet.

According to a fifteenth invention, in any one of the eighth to fourteenth inventions, in the third step, the droplets are continuously discharged at a rate of 300 shots or more per sec.

Advantageous Effect of the Invention

With the present invention, the discharge device capable of performing continuous discharge at a higher tact than in the past can be obtained while the device size is held small.

BRIEF DESCRIPTION OF THE DRAWINGS

FIG. 1 illustrates, in a way partially sectioned in principal parts, a discharge device according to a first embodiment.

FIG. 2 is a perspective view to explain a solenoid valve device. Specifically, FIG. 2(*a*) is a perspective view of the solenoid valve device, and FIG. 2(*b*) is a perspective view in a dismantled state of the solenoid valve device illustrated in FIG. 2(*a*).

FIG. 3 is a rear view of individual members constituting a holder. Specifically, FIG. 3(*a*) is a rear view of a grasping member, and FIG. 3(*b*) is a rear view of a relay member.

FIG. 4 is a graph plotting the relation among the number of solenoid valves, opening timings thereof, and a pressure reaching time. Specifically, FIG. 4(*a*) represents the case where the solenoid valves are opened at the same timing, and FIG. 4(*b*) represents the case where the solenoid valves are opened at different timings.

FIG. 5 illustrates, in a way partially sectioned in principal parts, a discharge device according to a second embodiment.

FIG. 6 illustrates, in a way partially sectioned in principal parts, a discharge device according to a third embodiment.

FIG. 7 illustrates, in a way partially sectioned in principal parts, a discharge device according to a fourth embodiment.

FIG. 8 illustrates, in a way partially sectioned in principal parts, a discharge device according to a fifth embodiment.

FIG. 9 illustrates, in a way partially sectioned in principal parts, a discharge device according to a sixth embodiment.

MODE FOR CARRYING OUT THE INVENTION

Examples of the mode for carrying out the present invention will be described below.

First Embodiment

A discharge device 1 according to a first embodiment relates to a discharge device including two solenoid valves, which are connected in parallel and which supply a compressed gas to a piston chamber. FIG. 1 illustrates, in a way partially sectioned in principal parts, the discharge device 1 according to the first embodiment. In the following, the side nearer to a discharge port 11 is called the front side, and the side nearer to a micrometer 42 is called the rear side in some cases for convenience of explanation.

Description is now made about a discharge unit 10 and a pressure supply unit 50 which are constituting the discharge device 1.

(Discharge Unit)

The discharge unit 10 includes, as main components, a main body 2 having a piston chamber 20, a piston 30 disposed in the piston chamber 20, and a nozzle block 3 in which a nozzle member 4 is disposed.

The piston chamber 20 is partitioned by the piston 30 into a front piston chamber 21 and a rear piston chamber 22. A sealing member is fitted over a lateral circumferential surface of the piston 30, and the piston 30 is slidable within the piston chamber 20 in a state closely contacted with the piston chamber 20.

The front piston chamber 21 is communicated with the pressure supply unit 50 through an air flow passage 49. When compressed air is supplied to the front piston chamber 21, the piston 30 is retreated, and when the compressed air in the front piston chamber 21 is released from the air passage 49, the piston 30 is advanced by a biasing force of a spring 40. The piston 30 is coupled to a rod (plunger) 33 such that a rod tip 35 is also reciprocally moved within a liquid chamber 13 together with reciprocal movement of the piston 30. On that occasion, the rod 33 is reciprocally moved in a state not in contact with a lateral surface of the liquid chamber 13. When the rod tip 35 abuts against a valve seat 15 that is provided in a bottom surface of the liquid chamber 13 at the front side (or in an inner wall thereof positioned in an advancing direction of the plunger), the liquid material is separated and discharged in the form of a flying droplet.

The piston 30 is further coupled to a rear abutment member 32.

A rear stopper 41 extending to enter a spring chamber 23 is disposed in a rear end portion of the main body 2. The rear stopper 41 comes into abutment against a rear end of the rear abutment member 32, thereby limiting rearward movement of the piston 30. A rear end of the rear stopper 41 is connected to the micrometer 42. A position of the rear stopper 41 in the forward and rearward direction can be adjusted by operating the micrometer 42.

The spring chamber 23 is communicated with the atmosphere through an air flow passage 24.

The nozzle block 3 is fixed to the front side of the main body 2. The nozzle member 4 is screwed to the nozzle block.

A liquid material supply passage 12 communicating with a liquid reservoir (not illustrated) is provided in a lateral portion of the nozzle block. The liquid material is supplied to the liquid chamber 13 inside the nozzle block through the liquid material supply passage 12.

(Pressure Supply Unit)

FIG. 2 is a perspective view to explain a solenoid valve device constituting the pressure supply unit 50, and FIG. 3 is a rear view of individual members constituting a holder.

A solenoid valve device is arranged integrally with the discharge unit 10 at the lateral side thereof, and it includes a solenoid valve A 61, a solenoid valve B 62, and a holder 70 that holds the solenoid valves A and B.

The solenoid valves 61 and 62 are each a selector valve that is switchable over between a first position at which a pressurized gas source (not illustrated) is communicated with the piston chamber 20 and a second position at which the piston chamber 20 is communicated with the atmosphere. The solenoid valves 61 and 62 have the same valve opening/closing speed and the same flow rate. Operations of the solenoid valves 61 and 62 are controlled by a controller 90 (not illustrated in FIG. 1). The solenoid valves 61 and 62 are constituted as an integral unit in a state held by the holder 70 such that they can be handled as one unit. Alternatively, the holder 70 may include a pressure reducing valve such that air pressure having been adjusted to a desired level is supplied to the solenoid valves.

The solenoid valve A 61 has an air supply port A 66, an air exhaust port A 67, and an air delivery port (not illustrated) formed at the rear side. The air delivery port is communicated with one of the air supply port A 66 and the air exhaust port A 67 by the action of the solenoid valve A 61.

The solenoid valve B 62 has an air supply port B 68, an air exhaust port B 69, and an air delivery port (not illustrated) formed at the rear side. The air delivery port is communicated with one of the air supply port B 68 and the air exhaust port B 69 by the action of the solenoid valve B 62.

The holder 70 is constituted by a grasping member (holding member) 71 and a relay member 72. The grasping member 71 and the relay member 72 are fixed to each other in a detachable manner.

The grasping member 71 has an air supply port 73 and an exhaust port 74 at the front side, and has an air delivery port A 75, an air inlet port A 76, an air delivery port B 77, and an air inlet port B 78 at the rear side. A flow passage for branching air supplied to the air supply port 73 is formed inside the grasping member 71. The length of a flow passage from the air supply port 73 to the air delivery port A 75 is the same as that of a flow passage from the air supply port 73 to the air delivery port B 77. Furthermore, the length of a flow passage from the air inlet port A 76 to the exhaust port 74 is the same as that of a flow passage from the air inlet port B 78 to the exhaust port 74.

The relay member 72 has an air reception port A 79 and an air reception port B 80 at the front side, and an air delivery port 81 at the rear side. The relay member 72 serves also to fix the solenoid valves A and B to the lateral surface of the main body 2 in a detachable manner. The relay member 72 is constituted such that the length of a flow passage from the air supply port A 66 to the air flow passage 49 is the same as that of a flow passage from the air supply port B 68 to the air delivery port 81. Furthermore, the length of a flow passage from the air delivery port 81 to the air exhaust port A 67 is the same as that of a flow passage from the air delivery port 81 to the air exhaust port B 69.

Description is now made about a route through which air supplied to the air supply port 73 from the pressurized gas source (not illustrated) via a pressure reducing valve is delivered to the front piston chamber 21. It is here assumed that the solenoid valves A and B are operated to be opened and closed at the same timing by the controller 90.

The compressed air supplied to the air supply port 73 is branched within the grasping member 71 to be supplied from the air delivery port A 75 to the air supply port A 66 and further from the air delivery port B 77 to the air supply port B 68.

The compressed air supplied to the air supply port A 66 passes through an inner flow passage of the solenoid valve A 61, and is delivered from an air delivery port (not illustrated) of the solenoid valve A 61 to the air reception port A 79 of the relay member 72. Similarly, the compressed air supplied to the air supply port B 68 passes through an inner flow passage of the solenoid valve B 62, and is delivered from an air delivery port (not illustrated) of the solenoid valve B 62 to the air reception port B 80 of the relay member 72. The air supplied to the air reception port A 79 and the air supplied to the air reception port B 80 are merged together in an inner flow passage of the relay member 72, and then supplied to the air flow passage 49 from the air delivery port 81 of the relay member 72.

As described above, it is possible to branch the air received from one pressure supply port to be supplied to two solenoid valves, which are arranged in parallel, through branched flow passages, to merge two streams of air together after passing through the solenoid valves, and to deliver the merged air to the discharge unit from one pressure delivery port.

Alternatively, timings of opening and closing the solenoid valves A and B may be shifted from each other. For example, the start of the retreat operation of the piston (plunger) can be moderated by slightly shifting the timings of opening the solenoid valves A and B such that the flow rate of the air flowing into the air chamber is changed over time. This is effective in preventing the occurrence of cavitation in the liquid chamber when the piston (plunger) is retreated.

FIG. 4 is a graph plotting the relation among the number of solenoid valves, opening timings thereof, and a pressure reaching time. The graph plots pressure change in a pressure chamber when the solenoid valve is opened and pressure is supplied to the pressure chamber. Specifically, FIG. 4(*a*) is a graph plotting pressure change when one solenoid valve is opened, and pressure change when two solenoid valves arranged in parallel are opened at the same timing. FIG. 4(*b*) is a graph plotting pressure change when one solenoid valve is opened, and pressure change when two solenoid valves arranged in parallel are opened at different timings. In each the graphs of FIGS. 4(*a*) and 4(*b*), a dotted line represents the pressure change when one solenoid valve is opened.

As seen from FIG. 4(*a*), when two solenoid valves (valve 1 and valve 2) having the same specifications are opened at the same timing, the pressure in the pressure chamber is increased to a higher level than the case of opening one solenoid valve from the start immediately after the opening of the solenoid valves. As a result, the plunger is moved at a higher speed in the case of opening the two solenoid valves at the same timing.

FIG. 4(*b*) is a graph representing the case where two solenoid valves (valve 1 and valve 2) having the same specifications are opened at different timings shifted from each other. In this case, at the beginning, because only one solenoid valve (valve 1) is opened, the pressure in the pressure chamber is increased along the same curve as that in the case of opening one solenoid valve. When the second solenoid valve (valve 2) is opened, a pressure rising rate is increased, and the pressure in the pressure chamber can reach the desired pressure at earlier timing than in the case of employing one solenoid valve.

When the plunger is abruptly retreated so as to generate negative pressure, cavitation tends to occur in some cases depending on the type of the liquid material. In such a case, by opening the two solenoid valves successively at different timings shifted from each other, a tact time can be shortened while prevention of the occurrence of cavitation is ensured. When finer control is desired, it is preferable to increase the number of solenoid valves as in a sixth embodiment described later.

In the above-described discharge device according to this embodiment, since plural solenoid valves each operating at a high speed are arranged in parallel to increase an amount of supplied air without increasing the supply pressure of the pressurized gas source, the tact time can be shortened without increasing the size and the weight of the device.

Furthermore, ultra-high speed discharge of droplets (e.g., 300 shots or more per sec, preferably 400 shots or more per sec, and more preferably 500 shots or more per sec) can be realized without increasing the device size. With the high-speed operation of the plunger rod, it is possible to not only increase efficiency of work, but also to discharge the liquid material in a smaller amount.

Second Embodiment

A discharge device 1 according to a second embodiment relates to a discharge device in which the plunger is advanced and then stopped in a state where the rod tip 35 and the bottom surface of the liquid chamber 13 at the front side (or the inner wall thereof positioned in the advancing direction of the plunger) are not contacted with each other (i.e., in a manner not abutting against the valve seat), thus applying an inertial force to the liquid material and discharging the liquid material in the form of a flying droplet. In the following, only different features from those in the first embodiment are described, and duplicate description of the same features is omitted.

FIG. 5 illustrates, in a way partially sectioned in principal parts, the discharge device 1 according to the second embodiment. The discharge device 1 according to the second embodiment is different from the first embodiment in that the piston 30 includes a collision portion 31 formed at the side in the advancing direction thereof, and the advance of the piston 30 is abruptly stopped upon the collision portion 31 colliding against the inner wall (bottom surface) of the piston chamber 20 at the front side. Because the rod tip 35 is not abutted against the valve seat, there is no risk that abrasion pieces or particles may be generated due to abutting of the rod tip against the valve seat. Furthermore, even when the liquid material contains a solid such as a filler, reduction of discharge accuracy caused by collapse or damage of the solid can be prevented, and the liquid material can be discharged without deteriorating the function and properties of the liquid material.

Though not illustrated in FIG. 5, the discharge device may include a plunger position determining mechanism (see Patent Document 2) that specifies the tip position of the plunger at the time when the advance of the plunger is stopped, to a desired position near the inner wall (bottom surface) of the liquid chamber, which is located in the advancing direction of the plunger.

The solenoid valves 61 and 62 and the holder 70 have the same structures as those in the first embodiment.

Also in this embodiment, the tact time can be shortened by increasing an amount of supplied air without increasing the supply pressure of the pressurized gas source. Furthermore, ultra-high speed discharge of droplets (e.g., 300 shots or more per sec, preferably 400 shots or more per sec, and more preferably 500 shots or more per sec) can be realized without increasing the device size.

Third Embodiment

A discharge device 1 according to a third embodiment relates to a discharge device in which two solenoid valves connected in parallel and supplying the compressed gas are connected to the piston chamber through different flow passages. In the following, only different features from those in the second embodiment are described, and duplicate description of the same features is omitted.

FIG. 6 illustrates, in a way partially sectioned in principal parts, the discharge device 1 according to the third embodiment. In FIG. 6, components corresponding to the pressure supply unit 50 in FIG. 1 are omitted, and the solenoid valve A 61, the solenoid valve B 62, and the controller 90 are mainly illustrated.

The discharge device 1 according to the third embodiment is different from the second embodiment in that the relay member 72 constituting the holder 70 has two air delivery ports 81 and 81 each of which is communicated with the air flow passage 49. More specifically, an air delivery port 81*a* formed in the relay member 72 is communicated with the air reception port A 79, and an air delivery port 81*b* formed therein is communicated with the air reception port B 80.

Also in this embodiment, the tact time can be shortened by increasing an amount of supplied air without increasing the supply pressure of the pressurized gas source. Furthermore, ultra-high speed discharge of droplets (e.g., 300 shots or more per sec, preferably 400 shots or more per sec, and more preferably 500 shots or more per sec) can be realized without increasing the device size.

Fourth Embodiment

A discharge device 1 according to a fourth embodiment relates to a discharge device in which a spring 40 is disposed under the piston 30. In the following, only different features from those in the first embodiment are described, and duplicate description of the same features is omitted. It is to be noted that, in FIG. 7, a syringe 8 is connected to the liquid material supply passage 12 through a tube 9, and this arrangement is similarly applied to the first to third embodiments.

FIG. 7 illustrates, in a way partially sectioned in principal parts, the discharge device 1 according to the fourth embodiment. The discharge device 1 according to the fourth embodiment is different from the first embodiment in that a spring 40 is arranged at the side in the advancing direction of the piston 30, and the piston 30 is advanced by supplying the compressed gas to the rear piston chamber 22. More specifically, when the compressed gas is supplied to the piston chamber through the solenoid valves 61 and 62, the piston 30 is advanced. When the compressed gas is released from the piston chamber through the solenoid valves 61 and 62, the piston 30 is retreated by a biasing force of the spring 40. Upon the rod tip 35 abutting against the valve seat 15 that is disposed in the inner wall (bottom surface) of the liquid chamber 13 at the front side, the liquid material is separated and discharged in the form of a flying droplet.

Furthermore, in this embodiment, the solenoid valves 61 and 62 are incorporated in a pressure supply unit 51. The pressure supply unit 51 has an air delivery port 81 formed at the rear side, and it is attached to the main body 2 such that the air delivery port 81 and the air flow passage 24 are communicated with each other. The pressure supply unit 51 has an air supply port 73 and an air exhaust port 74 both formed at the front side, and the air supply port 73 is communicated with the pressurized gas source through a pressure reducing valve 94.

Also in this embodiment, the tact time can be shorted by increasing an amount of supplied air without increasing the supply pressure of the pressurized gas source. Furthermore, ultra-high speed discharge of droplets (e.g., 300 shots or more per sec, preferably 400 shots or more per sec, and more preferably 500 shots or more per sec) can be realized without increasing the device size.

Fifth Embodiment

A discharge device 1 according to a fifth embodiment relates to a discharge device of the type that the liquid material comes into contact with a work before the liquid material departs from the discharge port (i.e., of the type opening and closing a discharge flow passage by a tip of a shaft member). In the following, only different features from those in the fourth embodiment are described, and duplicate description of the same features is omitted.

FIG. 8 illustrates, in a way partially sectioned in principal parts, the discharge device 1 according to the fifth embodiment. In the discharge device 1 according to the fifth embodiment, a liquid is discharged when a flow passage communicating with the discharge port 11 is opened and closed by the tip 35 of the rod 33 that is coupled to the piston 30. Thus, a liquid is discharged by the action of air pressure applied to a reservoir tank 97 instead of being discharged by the action of an inertial force applied to the rod 33.

Air pressure supplied from a pressure supply source is supplied to the reservoir tank 97, in which the liquid material is stored, through an air tube 6 after being adjusted to the desired pressure by a pressure reducing valve 95. The liquid material pressurized in the reservoir tank 97 is supplied to the liquid material supply passage 12 of the discharge device 1 through the liquid tube 9 from a pipe 96 having a fore end that is arranged near a bottom surface of the reservoir tank 97. The liquid material is then supplied to the liquid chamber 13 communicating with the liquid material supply passage 12. The liquid chamber 13 is constituted to be opened and closed at its end in the discharge direction by the tip 35 of the rod 33 of the discharge device 1. Upon the tip 35 of the rod 33 abutting against the valve seat 15, the flow passage connecting the liquid chamber 13 and the discharge port 11 of the nozzle member 4 is shut off.

Subsequently, when the rod 33 of the discharge device 1 is ascended, the liquid chamber 13 and the discharge port 11 of the nozzle member 4 are communicated with each other. Therefore, the liquid material is discharged from the discharge port 11 of the nozzle member 4 while it is pressed by the air pressure, which has been adjusted by the pressure reducing valve 95. The discharge is ended by descending the rod tip 35 to be abutted against the valve seat 15. The reservoir tank 97 stores the liquid material of several liters to several tens liters, for example.

The pressure supply unit 51 has the same structure as that in the fifth embodiment. The start of the retreat operation of the rod 33 can be moderated and the occurrence of cavitation can be prevented by slightly shifting operation timings of the two solenoid valves so as to open them successively.

Sixth Embodiment

A discharge device 1 according to a sixth embodiment relates to a discharge device including four solenoid valves connected in parallel. In the following, only different features from those in the second embodiment are described, and duplicate description of the same features is omitted.

FIG. 9 illustrates, in a way partially sectioned in principal parts, the discharge device 1 according to the sixth embodiment. In FIG. 9, components corresponding to the pressure supply unit 50 in FIG. 1 is omitted, and the solenoid valve A 61, the solenoid valve B 62, a solenoid valve C 63, a solenoid valve D 64, and the controller 90 are mainly illustrated.

The discharge device 1 according to the sixth embodiment is different from the second embodiment in that the device includes four solenoid valves and the holder 70 has a structure for holding the four solenoid valves.

The solenoid valves 61 to 64 have the same structure as the solenoid valves in the first and second embodiments. The grasping member 71 has the air supply port 73 and the exhaust port 74 at the front side, and has four air delivery ports A to D and four air inlet ports A to D at the rear side. The relay member 72 has four air reception ports A to D. Flow passages communicating with the air reception ports A to D are merged together such that the pressurized air is delivered to the discharge unit from one pressure delivery port 81. When the number of solenoid valves is large, it is preferable from the viewpoint of reducing the device size to deliver the pressurized air to the discharge unit after merging the flow passages communicating with the individual solenoid valves together.

The discharge device 1 according to this embodiment is suitable for opening the solenoid valves in a stepwise manner. In more detail, of the four solenoid valves arranged in parallel, the first solenoid valve is opened first, and then the second, third and fourth solenoid valves are opened successively in the mentioned order. As a result, the flow rate of the pressurized air at the start of the air supply to the air chamber can be reduced and the start of the retreat operation of the piston 30 can be made more moderate in comparison with the case of opening the four solenoid valves at the same timing.

Also in this embodiment, the tact time can be shortened by increasing an amount of supplied air without increasing the supply pressure of the pressurized gas source. Furthermore, ultra-high speed discharge of droplets (e.g., 300 shots or more per sec, preferably 400 shots or more per sec, and more preferably 500 shots or more per sec) can be realized without increasing the device size.

INDUSTRIAL APPLICABILITY

The present invention can be applied to the technique of discharging the liquid material by repeatedly operating a shaft member, which is called, e.g., a plunger, a valve shaft, or rod, in a reciprocal way at a high speed.

Furthermore, the present invention can be applied to not only the discharge technique of the type that the liquid material comes into contact with a work after the liquid material has departed from the discharge unit, but also to the discharge technique of the type that the liquid material comes into contact with a work before the liquid material departs from the discharge unit (i.e., of the type opening and closing the discharge flow passage by a tip of the shaft member).

LIST OF REFERENCE SYMBOLS

1: discharge device 2: main body 3: discharge block 4: nozzle member 5: air supply device 6: air tube 7: adapter 8: liquid reservoir (syringe) 9: liquid tube 10: discharge unit 11: discharge port 12: liquid material supply passage 13: liquid chamber 14: discharge flow passage 15: valve seat 20: piston chamber 21: front piston chamber 22: rear piston chamber 23: spring chamber 24: air flow passage 30: piston 31: collision portion, 32: rear abutment member 33: rod 35: tip 40: spring 41: rear stopper 42: micrometer 49: air flow passage 50: pressure supply unit (solenoid valve) 51: pressure supply unit 61: solenoid valve A 62: solenoid valve B 63: solenoid valve C 64: solenoid valve D 65: solenoid valve E 66: air supply port A 67: air exhaust port A 68: air supply port B 69: air exhaust port B 70: holder 71: grasping member 72: relay member 73: air supply port 74: air exhaust port 75: air delivery port A 76: air inlet port A 77: air delivery port B 78: air inlet port B 79: air reception port A 80: air reception port B 81: air delivery port 90: controller 94: pressure reducing valve 95: pressure reducing valve 96: pipe 97: reservoir tank

The invention claimed is:

1. A liquid material discharge device comprising:

a liquid chamber communicating with a discharge port, the liquid chamber being to be supplied with a liquid material;

a plunger coupled to a piston, the plunger having a plunger tip advancing and retreating within the liquid chamber such that the plunger tip never contacts the lateral surface of the liquid chamber;

a resilient member that applies a biasing force to the plunger;

a main body including a piston chamber in which the piston is disposed;

a solenoid valve assembly that supplies a pressurized gas, supplied from a pressurized gas source, to the piston chamber, or that exhausts the pressurized gas from the piston chamber; and a controller that controls operation of the solenoid valve assembly, wherein the solenoid valve assembly comprises a plurality of solenoid valves that are connected to a same space of the piston chamber in parallel, and each of the plural solenoid valves comprising a selector valve that switches between a first position at which the pressurized gas source communicates with the piston chamber and a second position at which the piston chamber is fluidly connected to the atmosphere.

2. The liquid material discharge device according to claim 1, wherein each of the plural solenoid valves has the same valve opening/closing speed and the same flow rate.

3. The liquid material discharge device according to claim 1, further comprising a holder including a holding member that holds the plural solenoid valves, and a relay member having an inner flow passage communicating the plural solenoid valves with the piston chamber, wherein the holding member has a supply port communicating with the pressurized gas source and has a plurality of delivery ports that distribute the pressurized gas, supplied to the supply port, to the plural solenoid valves, and the relay member has an inner flow passage that communicates the plural solenoid valves with the piston chamber.

4. The liquid material discharge device according to claim 3, wherein the relay member has a plurality of inner flow passages that communicate the plural solenoid valves individually with the piston chamber.

5. The liquid material discharge device according to claim 3, wherein the holder is detachably fixed to the main body.

6. The liquid material discharge device according to claim 1, wherein the solenoid valve assembly comprises three or four solenoid valves.

7. The liquid material discharge device according to claim 1, wherein the controller establishes communication between the pressurized gas source and the piston chamber by the individual solenoid valves actuating at different times from one another.

8. The liquid material discharge device according to claim 1, wherein the liquid material discharge device is a desk-top device.

9. The liquid material discharge device according to claim 3, wherein the relay member has an inner flow passage that merges plural streams of air together after passing through the solenoid valves.

10. The liquid material discharge device according to claim 1, wherein the piston chamber is partitioned by the piston into a front piston chamber and a rear piston chamber, and all the solenoid valves of the solenoid valve assembly are connected to either the front piston chamber or the rear piston chamber in parallel.

11. The liquid material discharge device according to claim 1, wherein the resilient member is arranged so as to bias the plunger rearward and the pressurized gas is supplied to the piston chamber so as to advance the plunger.

12. A liquid material discharge method comprising:

a step of preparing a liquid material discharge device including:

a liquid chamber communicating with a discharge port, the liquid chamber being supplied with a liquid material, a plunger coupled to a piston, the plunger having a plunger tip advancing and retreating within the liquid chamber such that the plunger tip never contacts the lateral surface of the liquid chamber, a resilient member that applies a biasing force to the plunger, a main body including a piston chamber in which the piston is disposed, a solenoid valve assembly that supplies a pressurized gas, supplied from a pressurized gas source, to the piston chamber, or that exhausts the pressurized gas from the piston chamber, and a controller that controls operation of the solenoid valve assembly;

a step of providing a plurality of solenoid valves connected to a same space of the piston chamber in parallel, each of the plural solenoid valves comprising a selector valve that switches between a first position at which the pressurized gas source communicates with the piston chamber and a second position at which the piston chamber is fluidly connected to the atmosphere;

a first step of operating the plural solenoid valves to communicate the pressurized gas source with the piston chamber at desired timings;

a second step of operating the plural solenoid valves to communicate the piston chamber with the atmosphere at the same timing; and a third step of continuously discharging droplets by repeating the first and second steps.

13. The liquid material discharge method according to claim 12, wherein each of the plural solenoid valves has the same valve opening/closing speed and the same flow rate.

14. The liquid material discharge method according to claim 12, wherein, in the first step, the plural solenoid valves communicate the pressurized gas source with the piston chamber at the same timing.

15. The liquid material discharge method according to claim 12, wherein, in the first step, the plural solenoid valves successively communicate the pressurized gas source with the piston chamber.

16. The liquid material discharge method according to claim 12, wherein the pressurized gas distributively supplied to the plural solenoid valves from one pressurized gas source is supplied to the piston chamber through one flow passage communicating with each of the plural solenoid valves.

17. The liquid material discharge method according to claim 12, wherein the pressurized gas distributively supplied to the plural solenoid valves from one pressurized gas source is supplied to the piston chamber through a plurality of flow passages communicating with the plural solenoid valves in one-to-one relation.

18. The liquid material discharge method according to claim 12, wherein the solenoid valve assembly comprises three or four solenoid valves.

19. The liquid material discharge method according to claim 12, wherein, in the second step, the plunger is advanced and stopped such that the plunger tip never contacts the inner wall of the liquid chamber, the inner wall being present in an advancing direction of the plunger, thereby applying an inertial force to the liquid material and discharging the liquid material in form of a droplet.

20. The liquid material discharge method according to claim 12, wherein, in the third step, the droplets are continuously discharged at a rate of 300 shots or more per second.

21. The liquid material discharge method according to claim 12, wherein the liquid material discharge device further comprising:

a holder including a holding member that holds the plural solenoid valves, and a relay member that has an inner flow passage communicating the plural solenoid valves with the piston chamber, wherein the holding member has a supply port communicating with the pressurized gas source and has a plurality of delivery ports that distribute the pressurized gas, supplied to the supply port, to the plural solenoid valves, and the relay member has an inner flow passage that communicates the plural solenoid valves with the piston chamber.

22. The liquid material discharge method according to claim 21, wherein the relay member has a plurality of inner flow passages that communicate the plural solenoid valves individually with the piston chamber.

23. The liquid material discharge method according to claim 21, wherein the relay member has an inner flow passage that merges plural streams of air together after passing through the solenoid valves.

24. The liquid material discharge method according to claim 12, wherein the piston chamber is partitioned by the piston into a front piston chamber and a rear piston chamber, and all the solenoid valves of the solenoid valve assembly are connected to either the front piston chamber or the rear piston chamber in parallel.

25. The liquid material discharge method according to claim 12, wherein the resilient member is arranged so as to bias the plunger rearward and the pressurized gas is supplied to the piston chamber so as to advance the plunger.

* * * * *